US005335378A

United States Patent [19]

Chiang

[11] Patent Number: 5,335,378

[45] Date of Patent: Aug. 9, 1994

[54] AUTOMATIC BATHING APPARATUS

[76] Inventor: Chou C. Chiang, 4th Floor, No. 11, Lane 48, Lunden Street, Shihlin District, Taipei City, Taiwan

[21] Appl. No.: 33,241

[22] Filed: Mar. 16, 1993

[51] Int. Cl.[5] ..... A47K 7/02

[52] U.S. Cl. ..... 4/606

[58] Field of Search ..... 4/606; 15/21.1, 53.1, 15/97.1

[56] References Cited

U.S. PATENT DOCUMENTS

| | | | |
|---|---|---|---|
| 3,078,484 | 2/1963 | Briggs | 15/21.1 |
| 3,768,462 | 10/1973 | Boulard | 15/21.1 X |
| 3,862,459 | 1/1975 | Brunette | 4/606 X |
| 4,071,021 | 1/1978 | Gallacci | 15/21.1 X |
| 4,733,421 | 3/1988 | Kuersteiner | 4/606 X |
| 4,817,227 | 4/1989 | Scott | 15/21.1 |
| 4,858,257 | 8/1989 | Bivens | 4/606 |
| 5,239,712 | 8/1993 | Kinder | 4/606 |

*Primary Examiner*—Charles E. Phillips
*Attorney, Agent, or Firm*—Ladas & Parry

[57] ABSTRACT

An automatic bathing apparatus including a carrier controlled by a lifting mechanism to carry a revolvable sponge cylinder and a water spray pipe and a massager up and down along two upright racks inside a housing, a concealable slidable sink and a water tap inside the housing, two revolvable auxiliary sponge cylinders mounted on the housing on the outside at lower elevations, an internal shower at the top, an external shower above the auxiliary sponge cylinders, a tooth mug holder and a dryer on the housing on the outside.

4 Claims, 6 Drawing Sheets

AUTOMATIC BATHING APPARATUS

BACKGROUND OF THE INVENTION

The present invention relates to a bathing apparatus for washing the body automatically. The machine is most suitable for the disabled or aged persons.

Taking a bath can not only clean the body but also relax the muscles. However, it is not a joyful thing to those disabled or aged persons to have a bath, more particularly during the winter season. The present invention helps the disabled and aged persons wash the body, and encourages them to enjoy bathing.

SUMMARY OF THE INVENTION

The main object of the present invention is to provide an automatic bathing apparatus which helps the disabled, weak and aged persons take a bath automatically. According to the preferred embodiment of the present invention, a first motor set is controlled to lift a water sprayer, a sponge-covered main roller, and a massager for cleaning and massaging the user when the user is standing inside the housing thereof, a second motor set controlled to turn two sponge-covered auxiliary rollers for cleaning the user when the user is sitting outside the housing. Showers are respectively fastened to the housing at suitable locations so that the user can take a shower bath either when the user is standing inside the housing or sitting outside the housing. A dryer may be mounted on the housing on the outside for drying the hair.

DETAILED DESCRIPTION OF THE PREFERRED EMBODIMENTS

Figure 1:
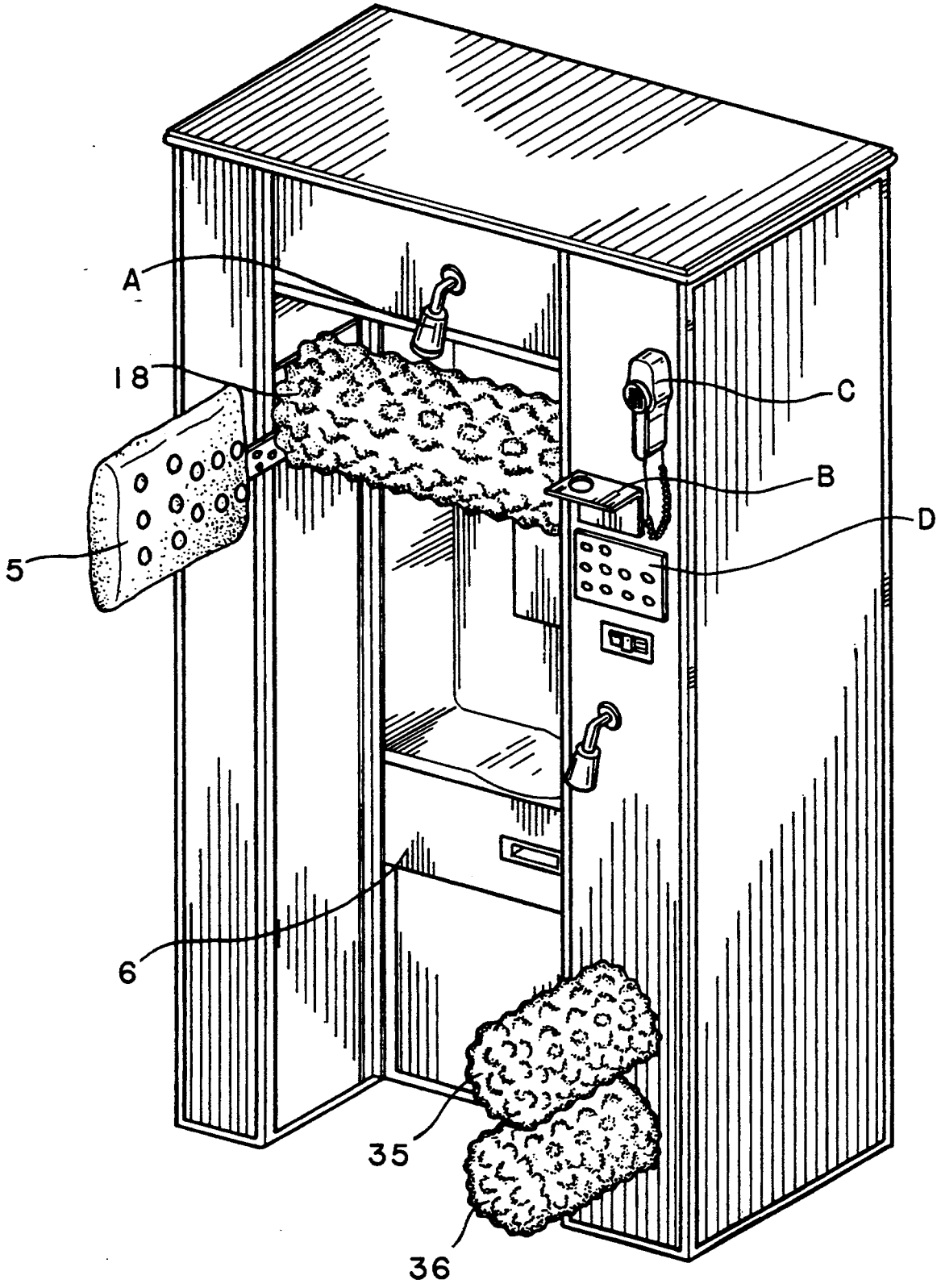
FIG. 1 is an elevational view of an automatic bathing apparatus constructed according to the preferred embodiment of the present invention.
Figure 2:
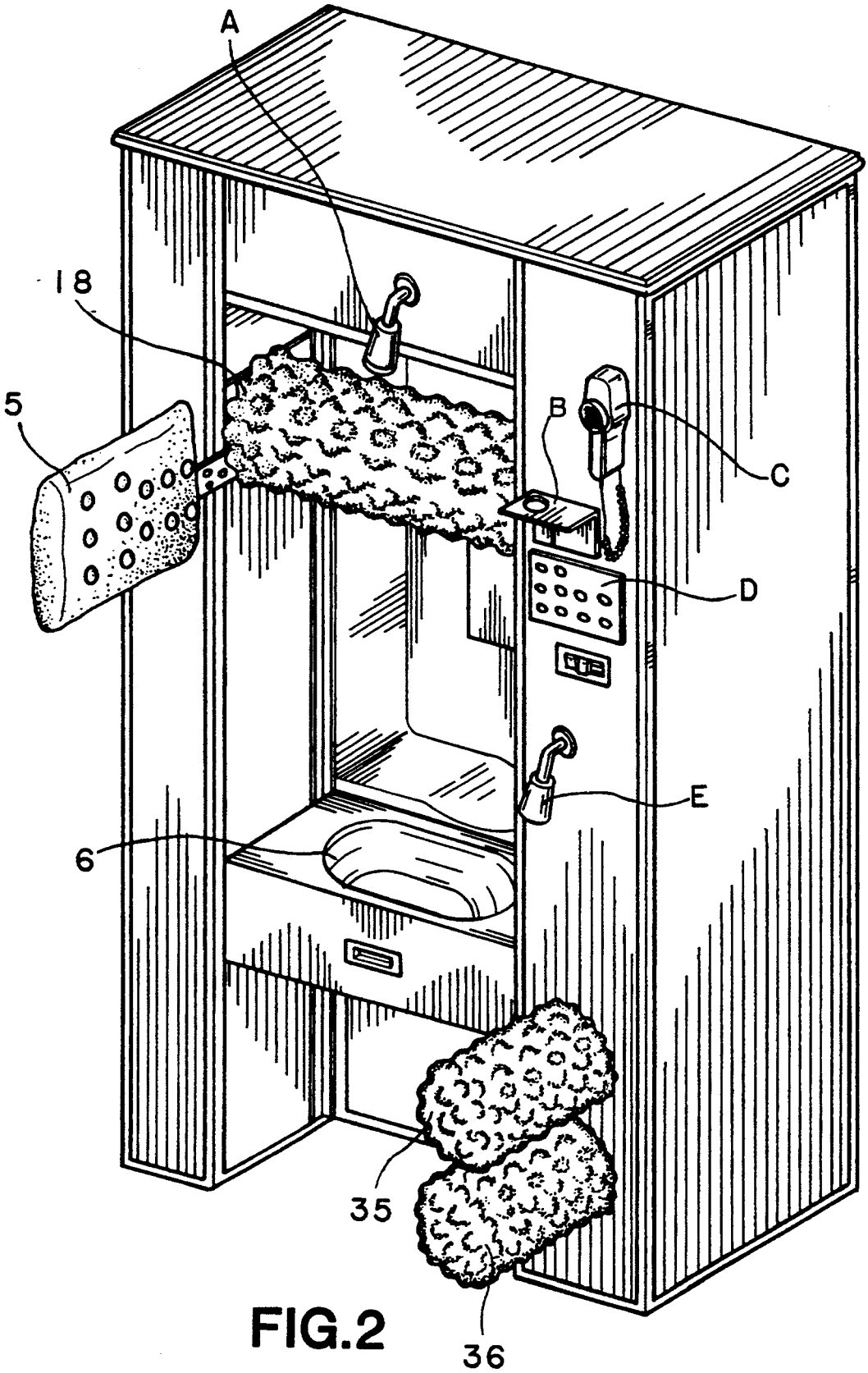
FIG. 2 is similar to FIG. 1 but showing the slidable sink moved into the operative position.

Referring to FIGS. 1 and 2, an automatic bathing apparatus constructed according to the preferred embodiment of the present invention is generally comprised of an upright housing having a control panel D, a tooth mug holder B, a dryer C, and showers A;E on the outside, a mirror F and a water tap G on the inside (see FIG. 6), a slidable sink 6 on the inside horizontally slidably disposed below the water tap G. The slidable sink 6 has a drain pipe (not shown) connected to the outside. A main roller 18 and a spray pipe 19 are transversely fastened inside the housing of the bathing apparatus (see also FIG. 5) and controlled by a lifting mechanism to move vertically up and down. A massage brush 5 is also coupled to the lifting mechanism and controlled through the control panel D to vibrate for massaging the body. Two parallel auxiliary rollers 35 and 36 are disposed on the outside at lower elevations. The main roller 18 or either auxiliary roller 35 or 36 may be covered with a respective massaging brush or cylinder sponge for cleaning the body. According to the preferred embodiment of the present invention, each roller is covered with a respective cylinder sponge. The auxiliary rollers 35 and 36 are designed for the people who can not stand up.

Figure 3:
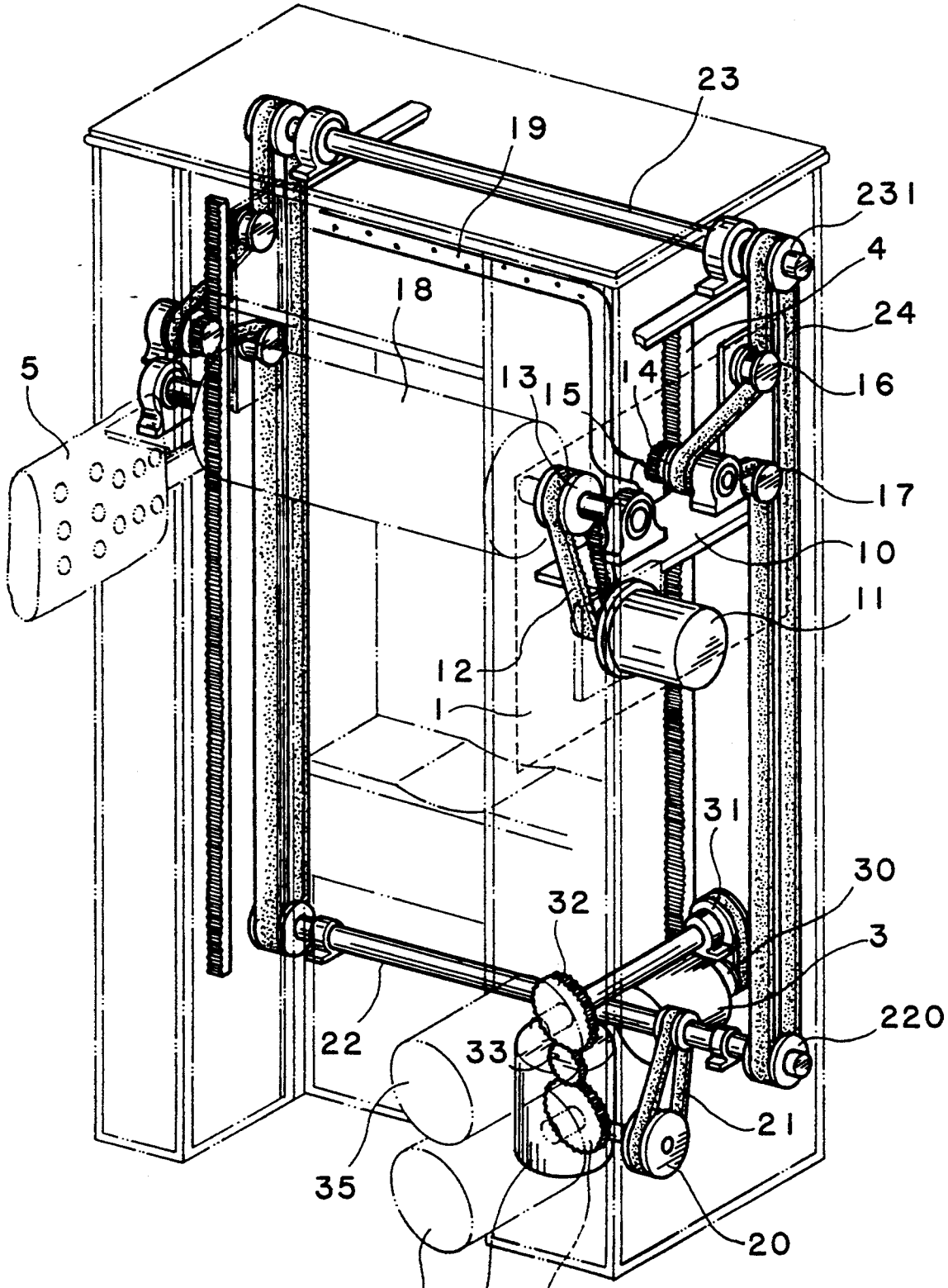
FIG. 3 is a perspective view showing the internal structure of the automatic bathing apparatus.
Figure 4:
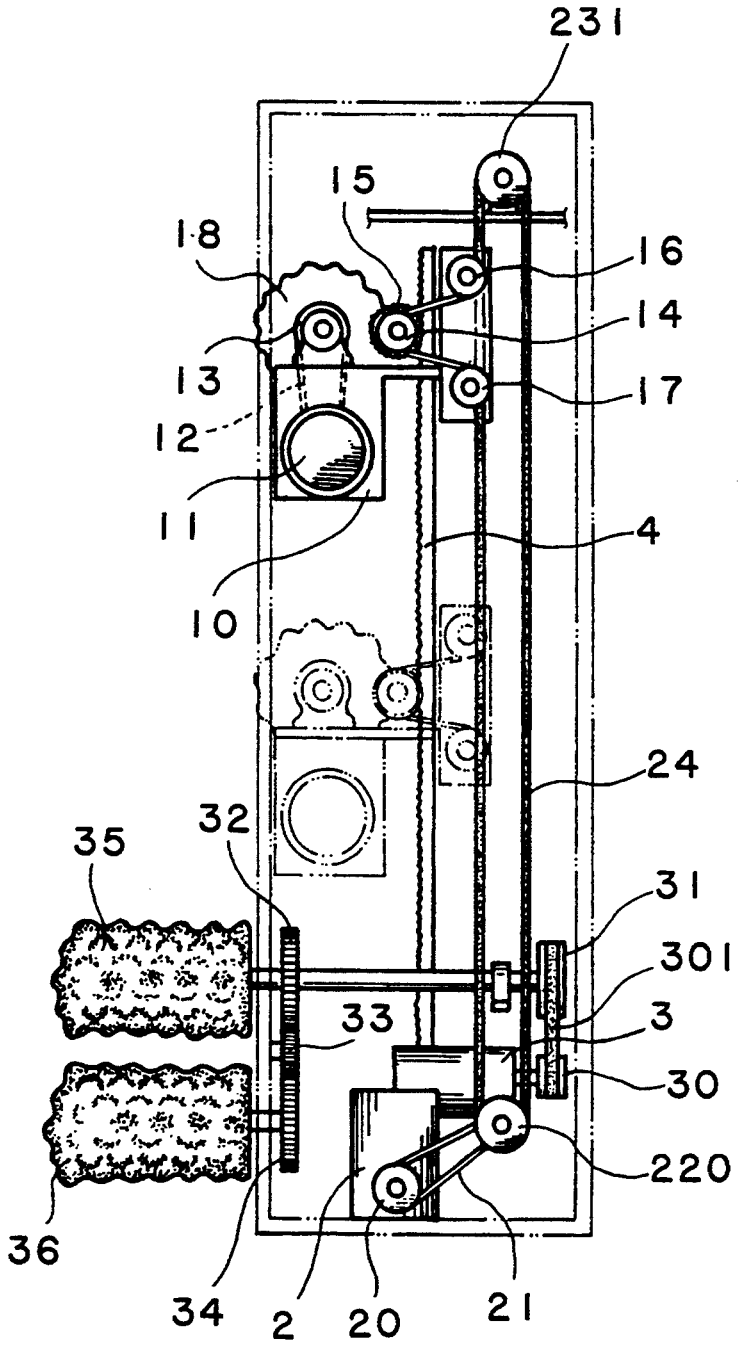
FIG. 4 is a side plan showing the movement of the lifting boards along the upright racks.

Referring to FIGS. 3 and 4, according to the foregoing statement, the main roller 18, the spray pipe 19, and the massage brush 5 are moved vertically up and down by a lifting mechanism. The lifting mechanism comprises two upright racks 4 bilaterally disposed inside the housing of the bathing apparatus, a top revolving shaft 23 transversely disposed at the top, which has belt pulleys 231 at two opposite ends thereof, a bottom revolving shaft 22 transversely disposed at the bottom, which has belt pulleys 220 at two opposite ends thereof, two transmission belts 24 bilaterally and respectively mounted between either belt pulley 231 on the top revolving shaft 23 and the corresponding belt pulley 220 on the bottom revolving shaft 22, two driven pulleys 14 respectively mounted on two horizontal lifting boards 10 at two opposite sides inside the housing of the bathing apparatus by bearings (not shown) and driven to rotate by the transmission belts 24, two gears 15 respectively coupled to the driven pulleys 14 and meshed with the upright racks 4. Tension pulleys 16 and 17 are fastened at suitable locations to control the tension of the transmission belts 24. The bottom revolving shaft 22 is driven to rotate by a first motor set 2 through a driving belt 21 and belt pulleys 20. Further, the main roller 18 and the spray pipe 19 are respectively mounted between the horizontal lifting boards 10. Therefore, turning on the first motor set 2 causes the horizontal lifting boards 10 to move the main roller 18 and the spray pipe 19 up and down along the upright racks 4. The main roller 18 has one end coupled with a belt pulley 13, which is coupled to the output shaft (not shown) of a second motor set 11 by a transmission belt 12. Therefore, turning on the second motor set 11 causes rotation of the main roller 18. The spray pipe 19 has two opposite ends respectively connected to a water supply pipe by a hose (not shown). When operated, fine drops of water are sprayed through the spray pipe 19 to wash the user while the cylinder sponge, namely, the main roller 18 is being moved to roll over the body of the user. The auxiliary rollers 35 and 36 are coupled with gears 32 and 34 respectively, which are meshed with an intermediate gear 33. The roller shaft of one auxiliary roller 35 is coupled with a belt pulley 31 linked to a transmission belt and belt pulley set 30 coupled to the output shaft of a third motor set 3. Turning on the third motor set 3 causes rotation of the auxiliary rollers 35 and 36.

Figure 5:
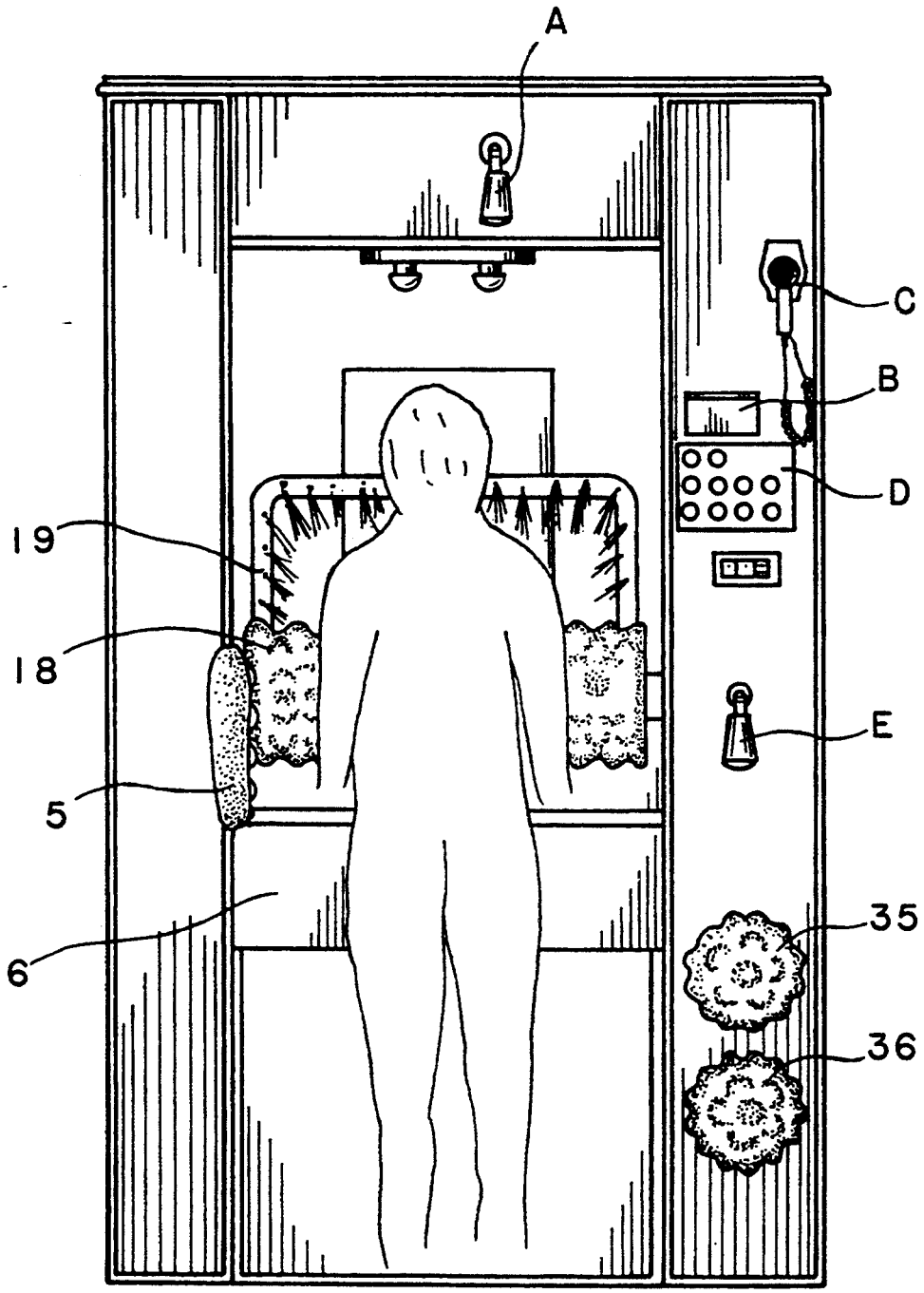
FIG. 5 is an applied view showing the user stood up in the housing to take a bath automatically.
Figure 6:
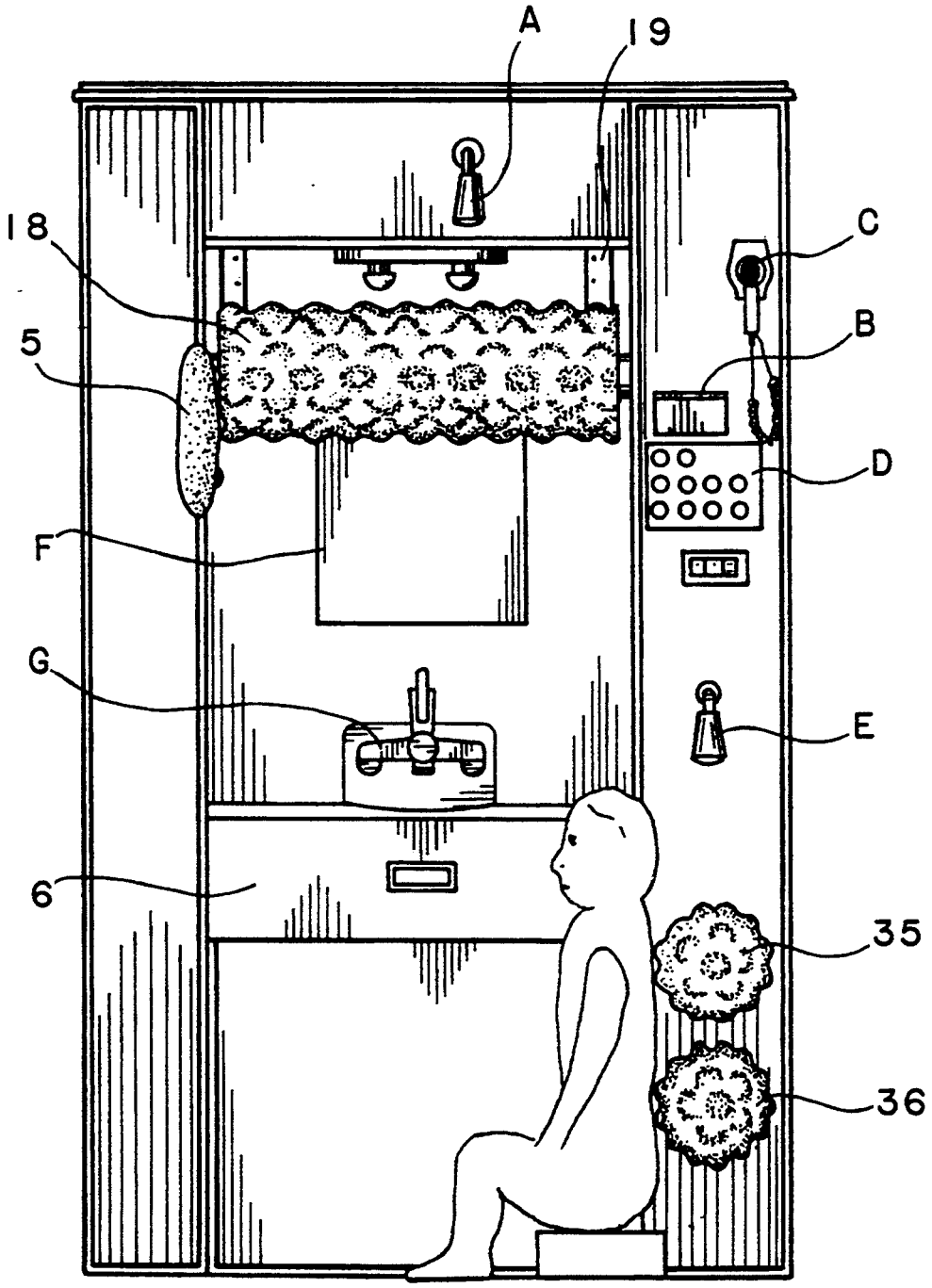
FIG. 6 is another applied view showing the user sit in a seat outside the housing to take a bath automatically.

Referring to FIGS. 5 and 6, the user may stand up inside the housing to take a bath automatically (see FIG. 5) or sit in a low seat with the body supported on the auxiliary rollers 35 and 36 for receiving the rubbing of the cylinder sponge of the rollers 35 and 36. After having been rubbed by the main roller 18 or the auxiliary rollers 35 and 36, which are respectively filled with a body cleaner, the shower A or E is turned on, and therefore the user can bathe in a shower.

I claim:

1. An automatic bathing apparatus comprising:

a housing having a concealable slidable sink on an inside thereof;

a main roller transversely disposed inside said housing for rubbing the body and having two opposite ends coupled to a carrier;

a water spray pipe transversely disposed inside said housing and having two opposite ends coupled to said carrier;

massaging means coupled to said carrier;

a lifting mechanism controlled to move said carrier vertically up and down inside said housing, said lifting mechanism comprising two upright racks bilaterally disposed inside said housing, a top revolving shaft transversely disposed at a top of the housing, a bottom revolving shaft transversely disposed at a bottom of the housing and linked to said top revolving shaft by tension roller-controlled transmission belts, two gears mounted on said carrier and respectively meshing with said upright racks, and a first motor drive controlled to turn said bottom revolving shaft through a driving belt and belt pulley assembly to cause said carrier to move along said upright racks;

a second motor drive controlled to turn said main roller on said carrier through a transmission belt and a belt pulley assembly;

a pair of auxiliary rollers fastened to said housing on an outside of the housing; and a third motor drive controlled to turn said auxiliary rollers through a transmission belt and belt pulley assembly.

2. The automatic bathing apparatus of claim 1 wherein said main roller and said auxiliary rollers are each covered with a respective cylinder sponge.

3. The automatic bathing apparatus of claim 1 wherein said housing further comprises a shower assembly, a tooth mug holder, and a dryer on the outside.

4. The automatic bathing apparatus of claim 1 wherein said auxiliary rollers are mounted on said housing on the outside at lower elevations for rubbing the user sitting on the outside.

* * * * *